US005395281A

United States Patent [19]

Tonello

[11] Patent Number: 5,395,281

[45] Date of Patent: Mar. 7, 1995

[54] METHOD AND APPARATUS FOR TREATING FABRIC

[76] Inventor: Osvaldo Tonello, Via della Fisica ⅓, 36030 Sarcedo (VI), Italy

[21] Appl. No.: 75,803

[22] Filed: Jun. 14, 1993

[51] Int. Cl.[6] ..... B24B 1/00

[52] U.S. Cl. ..... 451/28; 15/40; 26/28; 451/178

[58] Field of Search ..... 51/72 R, 80 R, 98 R, 51/98.5, 98 SP, 72 L, 326, 327, 281 R, DIG. 17; 26/27, 28, 29 R, 32; 15/40

[56] References Cited

U.S. PATENT DOCUMENTS

| | | | |
|---|---|---|---|
| 1,804,791 | 5/1931 | La Measure et al. | 51/80 |
| 2,685,766 | 8/1954 | McGovern | 51/98 R |
| 3,204,271 | 9/1971 | Kingston | 15/40 |
| 4,769,879 | 9/1988 | Otto | 26/27 |

FOREIGN PATENT DOCUMENTS

| | | |
|---|---|---|
| 0417659 | 3/1991 | European Pat. Off. . |
| 2525644 | 10/1983 | France . |
| 2628762 | 9/1989 | France . |

*Primary Examiner*—Jack W. Lavinder

*Attorney, Agent, or Firm*—Watson, Cole, Grindle & Watson

[57] ABSTRACT

The invention discloses a working method for giving a localized worn-out aspect to articles of clothing made of denim materials, which consists in treating the article of clothing (6, 70) fitted on a supporting manikin (2, 3) by means of the abrasive action of one or more rotating brushes (20, 21) contrasting against said article of clothing. The machine suited to carry out said working method comprises:

one or more manikins (2, 3) supporting the article of clothing to be treated (6, 70), each consisting of a supple structure (4, 5) suited to be inflated through inflating means (7, 8, 14) so that it will adhere to the article of clothing (6, 70), so as to simulate the shape it will acquire once it is worn by a person;

one or more rotating brushes (20, 21) attached to slides (24, 25) and sliding along rails (52, 53);

a structure (10) for supporting and moving the manikins (2, 3) suited to bring the manikins into the area of action of the rotating brushes and to remove them from there after the treatment has been completed.

11 Claims, 4 Drawing Sheets

METHOD AND APPARATUS FOR TREATING FABRIC

BACKGROUND OF THE INVENTION

1. Field of the Invention

The invention concerns a working method suited to give a worn out aspect to articles of clothing made of denim materials and a machine suited to carry out such a method.

2. General State of the Art

It is a known fact that the manufacturers of casual-fashion clothing made of denim materials in order to follow the trend of the market, treat the articles of clothing so as to give them a worn-out aspect.

In order to give the article of clothing said worn-out aspect, a washing operation is performed during which the article of clothing is treated with proper enzymes or with pumice powder, thereby producing the discolouring of the cloth and the worn out aspect previously mentioned. Sometimes it is also required that said articles of clothing present a worn out aspect which is localized only over particular areas. This is obtained by concentrating in the concerned areas a particularly strong discolouring operation through supplementary treatments.

One of the known methods used to perform such treatment consists in a very energetic manual brushing of the areas of the article of clothing where the discolouring is to be concentrated, thereby obtaining what in the technical jargon of this industrial sector is called "sanded effect". The inconveniences of such method of operation are rather obvious, the most evident being the length of time required by this operation and the ensuing high labour costs. Moreover, since this process must be performed manually, and depends exclusively on the operator's skill, it does not guarantee any continuity or reproduction of the same quality in the finished product.

Another known method consists in performing manually a localized sanding process by blasting the article of clothing with a mixture of air and sand. This method presents the same inconveniences presented by the before-described method with the addition that it is also highly polluting both for the environment and for persons involved in the process, so that it requires suitably equipped spaces for it to be carried out.

It is with the purpose of eliminating the mentioned inconveniences that the working method and the machine suited to carry it out, which are the object of the present invention are disclosed.

One of the purposes of the invention is to give the articles of clothing a worn-out aspect, localized in certain pre-determined areas, whereby the production costs are remarkably lower than those of other presently used methods.

Another purpose of the invention is to insure time and time again the continuity and the repetition of the same quality of the finished product.

Not the least purpose is to make the working process less polluting than the methods used at present, both for the persons involved and for the environment.

SUMMARY OF THE INVENTION

The mentioned purposes are reached through a working method for giving a localized worn-out aspect to articles of clothing made of denim materials, which, in accordance with the main claim, is characterized in that it comprises:

an operation whereby the article of clothing to be treated is fit on a supporting manikin, so that it acquires the shape which it will have once it is worn by a person;

a treatment operation consisting of the abrasive action generated by the relative motion between the mentioned article of clothing and one or more rotating brushes contrasting against said article of clothing;

an operation of removal of the article of clothing from the manikin after the treatment has been completed.

The machine suited to carry out the described working method comprises:

one or more manikins supporting the article of clothing to be treated, each consisting of a supple structure, suited to be inflated through inflating means, so that it will adhere to the article of clothing, so as to simulate the shape it will acquire when it is worn by a person;

one or more rotating brushes, each applied on a slide moving along a rail, said slides being provided with displacing means suited to bring said brushes into contrast against or to move them away from the article of clothing to be treated;

a structure for supporting and moving the manikins, suited to arrange said manikins and the articles of clothing put on them into at least two positions, one of them being the treatment position, in correspondence with the area of action of the rotating brushes, the other position being suited for fitting the article of clothing on the manikin and removing it from the same, said position being removed from the area of operation of the rotating brushes;

kinematic units driving the brushes into rotation, the slides along the rails and the displacement of the structure supporting the manikins.

According to a preferred embodiment the machine suited to carry out the working method according to the invention comprises a pair of manikins which support the articles of clothing to be treated and are connected with a structure supporting them and causing them to move, said structure consisting of a transversal beam being supported in the middle by a vertical upright.

Said upright is driven into rotation by a driving unit, so that it will alternatively bring the manikins attached to the end of the transversal beam into contact with the rotating brushes.

The brushes, of which there are two, are counterposed to each other, and they perform the treatment of the article of clothing by combining their rotational movement against the article of clothing itself with their vertical translating movement along rails which are arranged vertically.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description and from the drawings, wherein.

DESCRIPTION OF THE PREFERRED EMBODIMENTS

Figure 1:
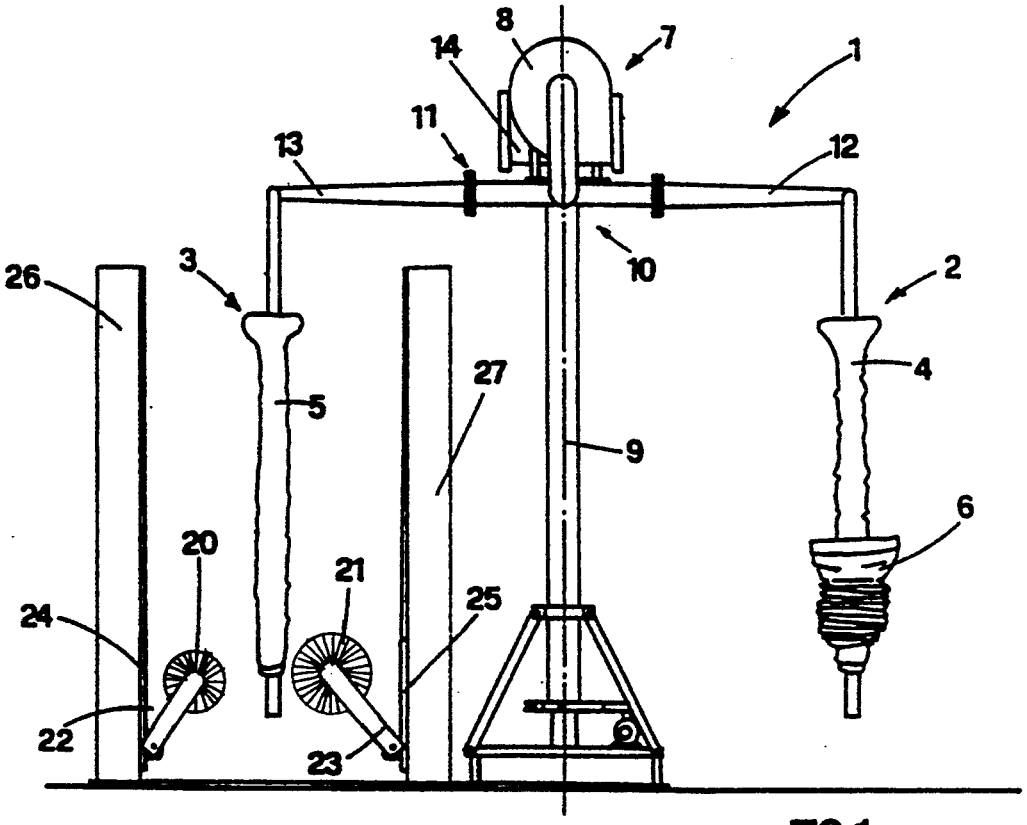
FIG. 1 represents the machine according to the invention with the article of clothing to be treated while it is being fitted on the manikin.

As can be observed in FIG. 1, the machine according to the invention, which is indicated as a whole with 1, comprises a pair of manikins 2 and 3, each consisting of a supple structure, 4 and 5 respectively. The articles to be treated 6 are fitted on said structure. Said supple structures 4 and 5 are inflated by inflating means, indicated as a whole with 7, so that the article of clothing 6, fully fitted on the manikin 2, as can be observed in FIG. 2, will adhere to the mentioned supple structure 4, so that it essentially acquires the shape which it will have when it is worn by a person, i.e. the shape represented in FIG. 3.

It is necessary to specify that the present description refers to the manikins 2 and 3, which present the supple structures 4 and 5, each suited to receive an article of clothing to be treated, which in the specific case is a pair of pants 6. It is, however, understood that this case is given by way of illustration only, since the articles of clothing to be treated can be of any kind, such as shirts, coats or others, to support which it suffices to change the shape of the manikins 2 and 3 and of the supple structures 4 and 5.

The manikins 2 and 3 are arranged at the ends of a supporting and moving structure, indicated as a whole with 10, which comprises a vertical upright 9, resting on the floor, its upper end being connected in the middle of a transversal beam 11. Said beam comprises two pipes 12 and 13, connected with fan 8 and fan 14 respectively, only their suction openings being visible in the Figure. Said pipes send air into the supple structures 4 and 5 respectively of the manikins 2 and 3.

It will be pointed out that the present description, which takes into consideration a pair of manikins is given by way of illustration only, since there can be any number of manikins.

As for the inflating unit 7, which, as has been described, consists of the two fans 8 and 14, it can also consist of different devices, which must at any rate be capable of giving the desired shape to the supple structures 4 and 5 of the manikins 2 and 3.

A pair of brushes 20 and 21 is an integral part of the machine. Said brushes are counterposed to each other and they are attached through arms 22 and 23 respectively, to a corresponding number of slides 24 and 25, which can move vertically along the rails 26 and 27.

Figure 2:
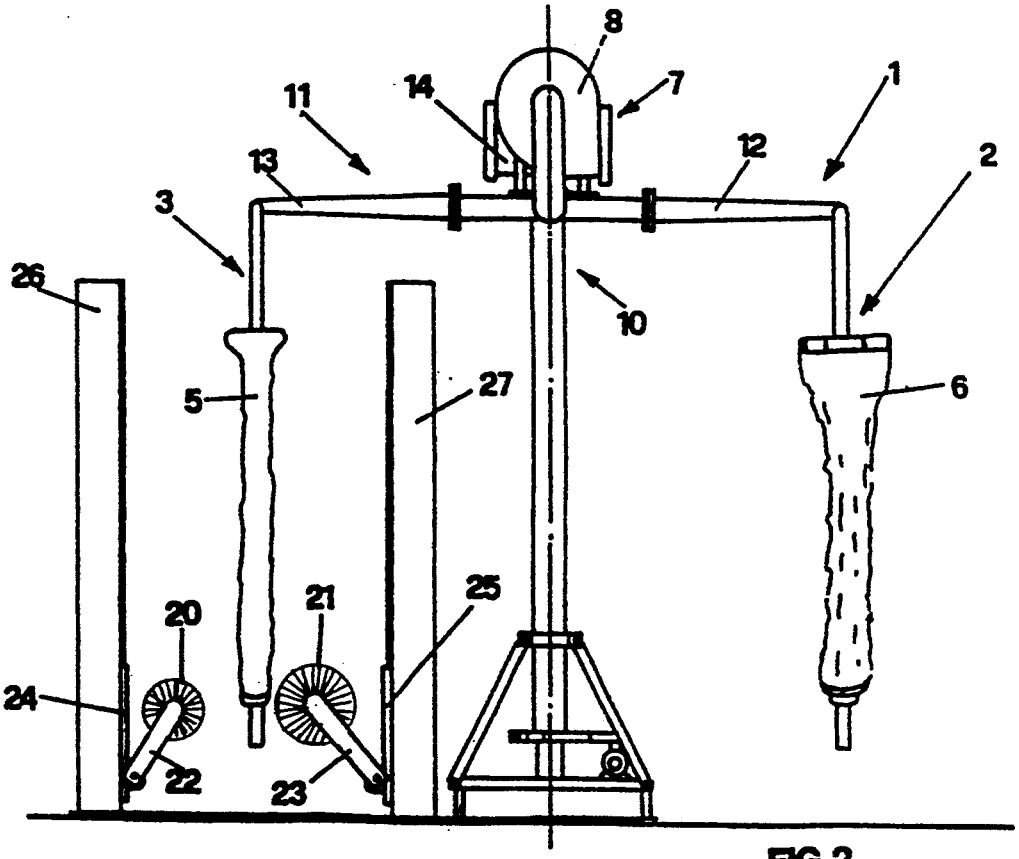
FIG. 2 shows the machine of FIG. 1 with the article of clothing to be treated already fitted on the manikin.

The working cycle begins when the article to be treated 6 is put on manikin 2, as can be observed in FIG. 1, until it is completely fitted on it, as can be observed in FIG. 2.

Figure 3:
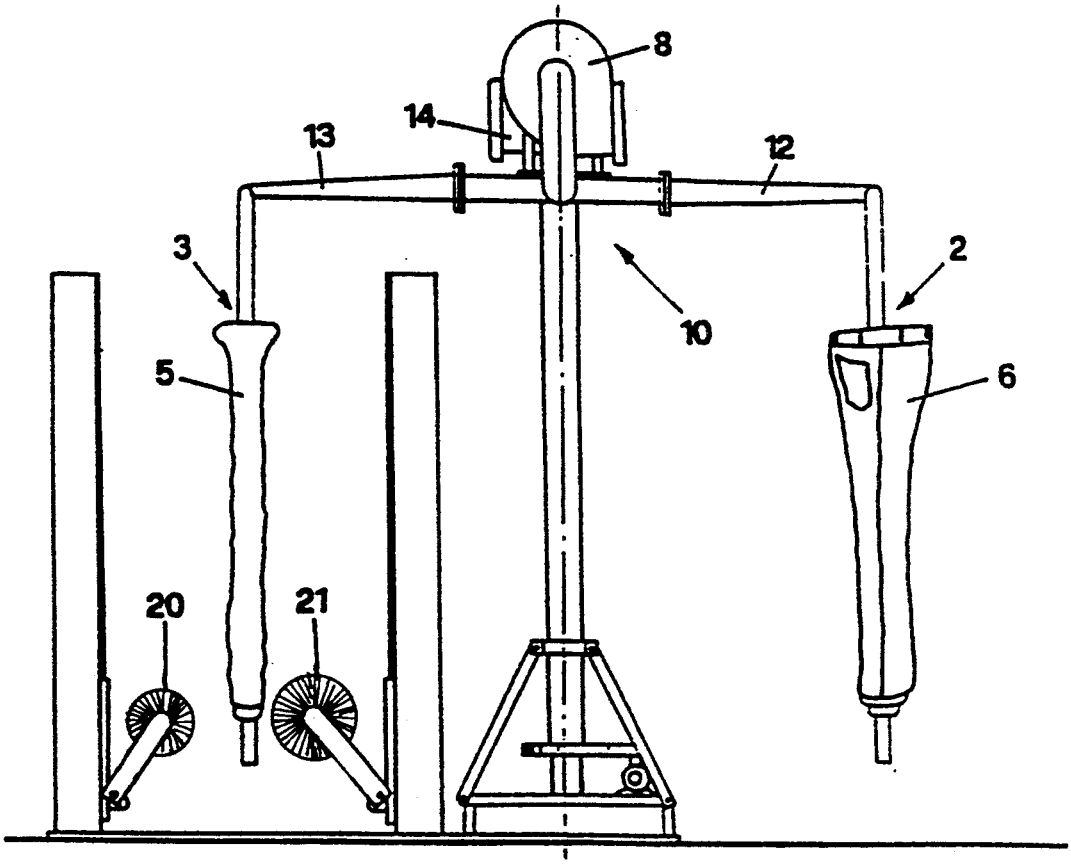
FIG. 3 represents the machine of FIG. 2 with the article of clothing to be treated fitted on the manikin and having the shape it will acquire when it is worn by a person.
Figure 4:
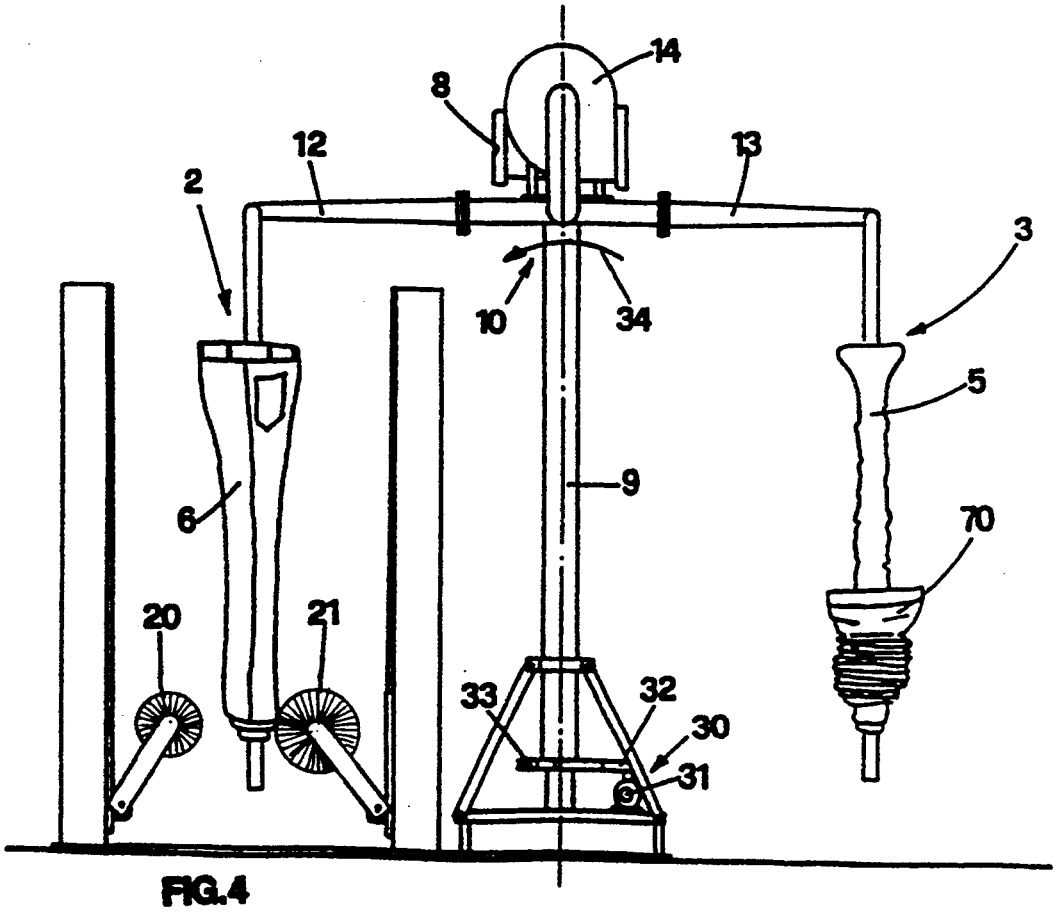
FIG. 4 shows the machine of FIG. 3 with the article of clothing to be treated positioned in the area of action of the rotating brushes.
Figure 6:
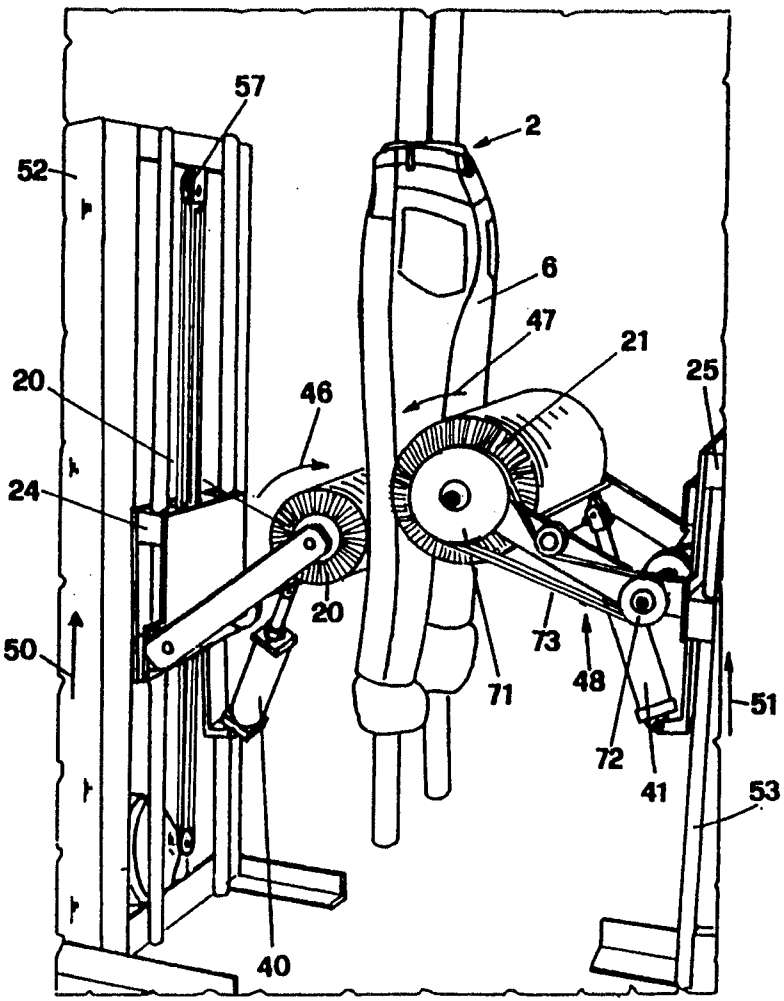
FIG. 6 represents the detail of FIG. 5 with the article of clothing during the treatment operation.
Figure 5:
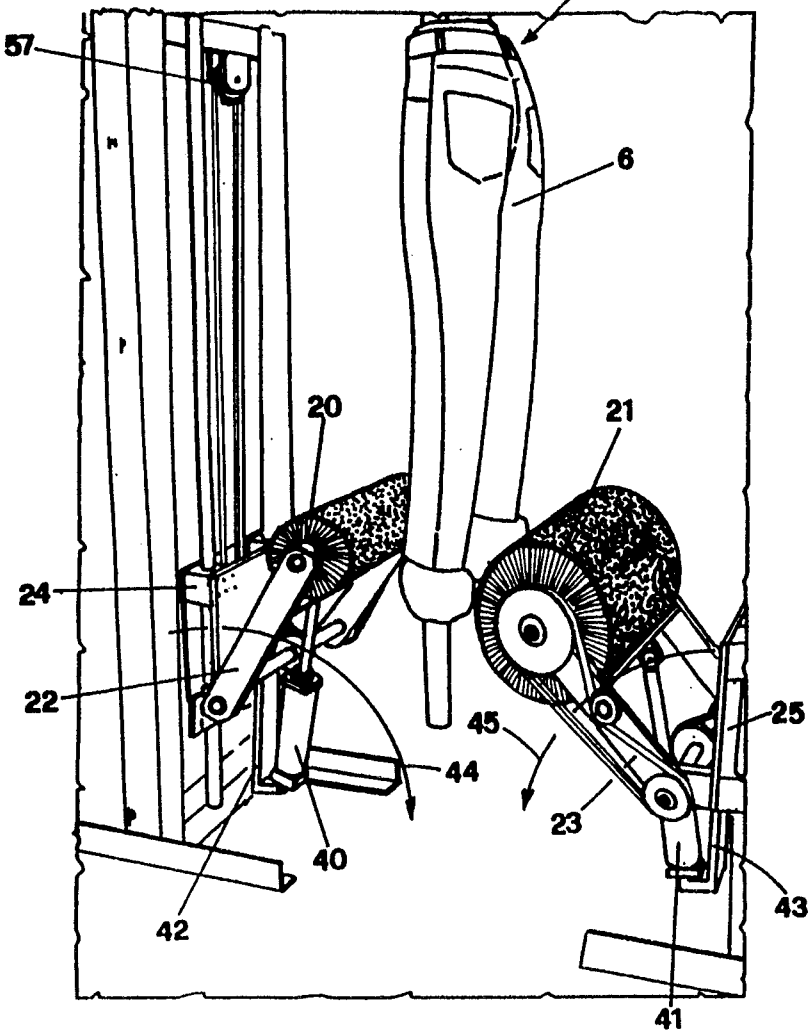
FIG. 5 represents a detail of the machine concerning the article of clothing to be treated positioned in the area of action of the rotating brushes at the beginning of the treatment operation.
Figure 8:
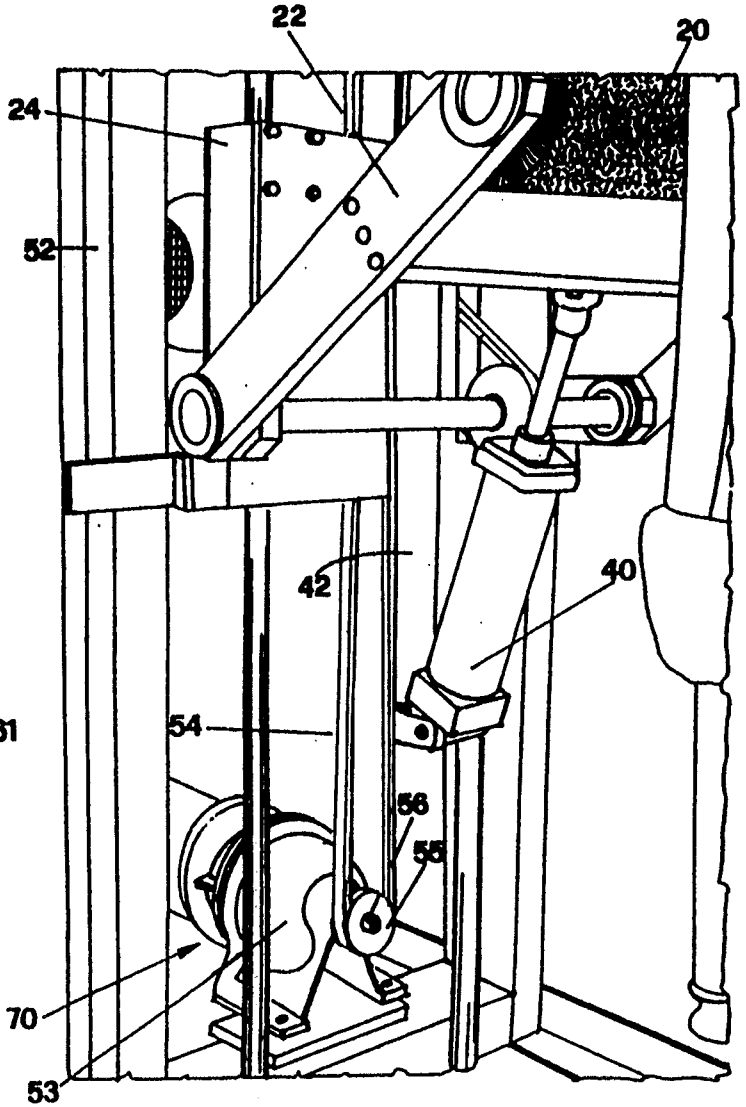
FIG. 8 shows the detail concerning the driving units of the rotating brushes and of the slides to which said brushes are attached.

Through fan 8 and pipe 12, as can be seen in FIG. 3, the article of clothing 6 is inflated, so that it essentially acquires the shape it will have when it is worn by a person. Thereafter, it is brought into the area of action of the rotating brushes 20 and 21, as can be observed in FIG. 4. In order for this to be possible, the supporting and moving structure 10 is provided with a driving unit, indicated as a whole with 30, consisting of an electric motor 31, which, through a transmission chain 32, engaging a cog wheel 33, rigidly attached to the vertical upright 9, causes beam 11 to rotate in the direction indicated by arrow 34. This rotating movement brings the article of clothing 6 and manikin 2 on which it is fitted into the area of action of the rotating brushes 20 and 21, as represented in FIG. 4. At this point, the rotating brushes 20 and 21 are positioned, as can be observed in the magnified detail of FIG. 5, removed from the article of clothing 6. Therefore, in order for them to be able to perform the treatment on the article of clothing, they must be brought into contact with the same. This is done by means of a pair of actuators 40 and 41, which are connected through the brackets 42 and 43 with the slides 24 and 25 supporting the rotating brushes 20 and 21. When said actuators are activated, they cause the brushes to rotate through the arms 22 and 23, the rotation occurring following the directions indicated by the arrows 44 and 45 respectively, thereby causing the brushes to adhere against the article of clothing 6, as represented in FIG. 6. Through suitable electric means, such as limit switches (not represented in the drawing) the brushes are driven to rotate following the directions 46 and 47 by kinematic units. FIG. 6 shows only the kinematic unit 48 belonging to brush 21 and consisting of the pulleys 71 and 72 which are driven to rotate through the driving belt 73 by an electric motor (not represented in the drawing). When the brushes are rotating, they begin the vertical movement following the directions 50 and 51 respectively because of the upward movement of the slides 24 and 25 along the rails 52 and 53. Said vertical movement of each slide is driven by a kinematic unit 70, visible in better detail in FIG. 8, and belonging to slide 24. It can be observed that it comprises an electric motor 53 driving a transmission chain 54, which in turn engages cog wheels (not represented in the drawing) placed inside the slide 24 itself. The transmission chain 54 is positioned between pinion 55, rigidly attached to shaft 56 of motor 53 and another pinion 57, attached to rail 52, as can be observed in FIG. 6.

An analogous kinematic unit, which will not be described, generates at the same time, the vertical displacement of slide 25 supporting the rotating brush 21 following direction 51.

Figure 7:
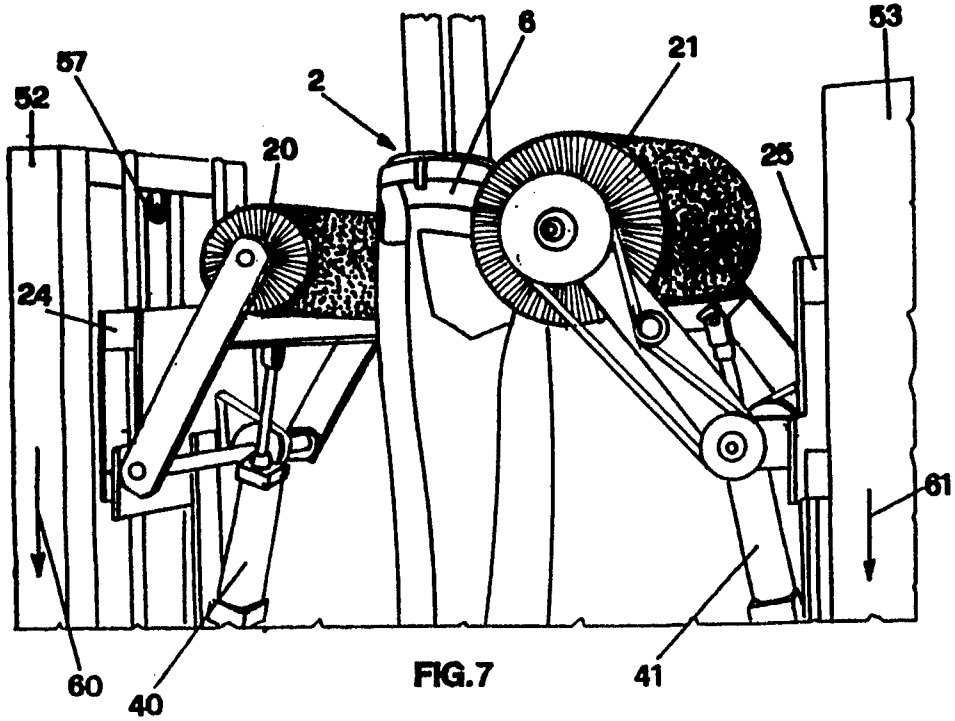
FIG. 7 shows the detail of FIG. 6 with the brushes in the position they acquire at the end of the treatment operation on the article of clothing.

When the rotating brushes 20 and 21 have run along the entire length of the article of clothing 6, as can be observed in FIG. 7, they are first removed from the article of clothing 6, then their rotating movement is stopped and finally, the slides 24 and 25 supporting them are vertically moved downwards following directions 60 and 61, until they resume the initial position represented in FIG. 4.

In the meantime, i.e. beginning from the point in time represented in FIG. 4, when the article of clothing 6 is positioned in the area of action of the rotating brushes 20 and 21, the operator (not represented in the drawing) begins to put on the manikin 3 another article of clothing to be treated 70, which will then be fitted on the supple structure 5, which in turn will be inflated by fan 14. Thus it will be ready to be brought into the area of action of the rotating brushes 20 and 21, as soon as these will have resumed the initial positions represented in FIG. 4, after they have completed the treatment operation on the article of clothing 6. At this point, another rotation of the supporting and moving structure 10 carries the article of clothing 70 into the area of action of the rotating brushes, so that the already treated article of clothing 6 can be removed from manikin 2 supporting it. The process can thus repeatedly continue without interruption.

On the basis of what has been described, it can be easily understood how the proposed purposes have been achieved. In the first place the purpose of considerably reducing the time necessary for the working cycle has been achieved, since the operations for moving the articles of clothing are limited to the fitting on the manikins and to the removal from the same and no further movement of the article of clothing is necessary during the treatment itself, as opposed to what happens with the manual methods used at present.

Moreover, said operations of fitting and removing the articles of clothing occur while a previously put on article is being treated and, therefore, the cycle time consists entirely of working time, while the machine is in operation. Therefore, an optimum exploitation of the equipment is achieved.

Moreover, the fact that the treatment is performed by means of rotating brushes, which run along the same track, in the same amount of time, at the same speed and exerting the same pressure on the article of clothing, permits to obtain a better quality of the finished product and, even more important, the repetition of the same quality.

Moreover, the working process is less hazardous to the health of the operator, since he is not forced to remain in the treatment area and the dust which may result from the treatment can easily be captured by suction hoods.

During the manufacturing process the machine according to this invention may undergo-construction changes with the purpose of simplifying its manufacture or of improving its performance. Thus, for instance, all the described kinematic units may indifferently consist of chain and cog-wheel transmissions or of belts and pulleys or of other means. The actuators may also be either pneumatic or hydraulic.

The following has not been described, but its presence has been mentioned: the limit switches for the adjustment of the stop positions of the stroke of the slides supporting the rotating brushes; the proximity switches or micros controlling the start and stop of the rotational movement of the rotating brushes, all of this being controlled by an electric or electronic control board.

Moreover, the relative displacement movement between the rotating brushes and the article of clothing, which in the specific described case is performed by the brushes, may also be performed by the article of clothing or by both the article of clothing and the brushes.

All the mentioned possible variations and modifications must, however, be considered as falling within the spirit and the scope protected by the present invention.

I claim:

1. A method for imparting a localized worn-out appearance to an article of clothing made of denim materials, comprising the steps of:

a fitting operation whereby the article of clothing to be treated is fit on a supporting manikin, so that it acquires a shape similar to which it will have once it is worn by a person;

a treatment operation of abrasive action generated by relative motion between the article of clothing and at least one rotating brush contacting against said article of clothing;

an operation of removal of the article of clothing from the manikin after the treatment has been completed.

2. A machine for imparting a localized worn-out appearance to articles of clothing to be treated thereby comprising:

at least one manikin for supporting thereon the article of clothing to be treated, each comprising a supple inflatable structure; inflating means for inflating the manikin, so that it will adhere to the article of clothing, so as to simulate a shape similar to which it will acquire when it is worn by a person;

at least one rotating brush; a slide and rail for reciprocally supporting each brush and a displacing means operatively coupled to the slide for engaging said brushes into contact with the article of clothing to be treated;

a structure for supporting and moving the manikins and articles of clothing carried thereby into at least first and second positions, said first position being a treatment position, proximate the at least one brush, and the second position being a fitting position for fitting the article of clothing on the manikin and removing it from the same, said second position being remote from the treatment position; and kinematic means for driving the at least one brush into rotation, the slides along the rails and the displacement of the structure supporting the manikins.

3. A machine according to claim 2, wherein the structure for supporting and moving the manikins comprises a vertical upright having an upper end; and a transversal beam carried on the upper end, said beam having ends, each supporting one manikin.

4. A machine according to claim 3, wherein the transversal beam includes pipes aligned with each other, each pipe having end portions; inflating means coupled to one end of each pipe, and the other end being connected with the supple structure of the manikin.

5. A machine according to claim 3, wherein the kinematic means further comprises: an electric motor; a chain; and a pinion rigidly attached to the structure, the chain being coupled between the electric motor and the pinion.

6. A machine according to claim 2, wherein the inflating means comprise fans.

7. A machine according to claim 2, wherein the kinematic means further comprises: an electric motor; pulleys on the motor and the structure supporting the manikins; and at least one belt coupled between the pulleys and the electric motor.

8. A machine according to claim 2, wherein the kinematic means further comprises: a shaft; a pinion rigidly attached to the shaft and a transmission pinion rigidly attached to the corresponding rail for engaging the transmission and being located inside the slide.

9. A machine according to claim 2, wherein the kinematic means against the article of clothing to be treated, further comprises: an actuator attached to the slide supporting the brush, the actuator including a stem; an arm coupled to the stem and having a fulcrum on the slide.

10. A method for imparting a localized worn-out appearance to an article of clothing to be treated comprising the steps of:

fitting the article of clothing to be treated on a supporting manikin;

inflating the article;

abrading the inflated article by abrasive action generated by relative motion between the article of clothing and at least one rotating brush contacting against said article of clothing; and removing the article of clothing from the manikin after the abrading step.

11. An apparatus for imparting a localized worn-out appearance in an article of clothing to be treated comprising:

at least one manikin supporting the article of clothing to be treated, the manikin comprising a supple inflatable structure;

inflating means coupled to the manikin so that it will adhere to the article of clothing thereon;

at least one rotatable brush reciprocally mounted for engaging the article on the manikin;

means coupled to the brush for reciprocally driving the brush into contact with the article and for rotating the brush thereagainst; and means for supporting the manikin having first and second positions, the first position located proximate the brush for engaging the article and the second position remote from the brush for fitting the article of clothing thereon.

* * * * *